US012653246B2

(12) United States Patent
Pueschner et al.

(10) Patent No.: US 12,653,246 B2
(45) Date of Patent: Jun. 16, 2026

(54) DEVICE FOR AN ELECTRONIC CIGARETTE, ELECTRONIC CIGARETTE, METHOD FOR FORMING A DEVICE FOR AN ELECTRONIC CIGARETTE, AND METHOD FOR FORMING AN ELECTRONIC CIGARETTE

(71) Applicant: Infineon Technologies AG, Neubiberg (DE)

(72) Inventors: Frank Pueschner, Kelheim (DE); Josef Gruber, St. Ruprecht An Der Raab (AT); Bala Nagendra Raja Munjuluri, Bangalore (IN); Walther Pachler, Wetzelsdorf (AT); Jens Pohl, Bernhardswald (DE); Thomas Spoettl, Mintraching (DE)

(73) Assignee: Infineon Technologies AG, Neubiberg (DE)

( * ) Notice: Subject to any disclaimer, the term of this patent is extended or adjusted under 35 U.S.C. 154(b) by 774 days.

(21) Appl. No.: 17/592,848

(22) Filed: Feb. 4, 2022

(65) Prior Publication Data

US 2022/0240593 A1 Aug. 4, 2022

(30) Foreign Application Priority Data

Feb. 4, 2021 (DE) ..... 102021102609.1

(51) Int. Cl.
*A24F 40/65* (2020.01)
*A24F 40/57* (2020.01)

(52) U.S. Cl.
CPC ..... *A24F 40/65* (2020.01); *A24F 40/57* (2020.01)

(58) Field of Classification Search
CPC ..... A24F 40/65; A24F 40/57
See application file for complete search history.

(56) References Cited

U.S. PATENT DOCUMENTS 9,864,947 B1 * 1/2018 Sur ..... A24F 15/01
2020/0036080 A1 1/2020 Ourednik et al.

FOREIGN PATENT DOCUMENTS

CN 109952585 A 6/2019
CN 210869895 U 6/2020
(Continued)

OTHER PUBLICATIONS

German Patent Office, Office Action issued for DE 102021102609.1, 6 pgs., dated: Oct. 13, 2021.
Feb. 4, 2026 (CN) Office Action—App. 202210120187.3.

*Primary Examiner* — Linda L Gray
(74) *Attorney, Agent, or Firm* — Banner & Witcoff, Ltd.

(57) ABSTRACT

A device for an electronic cigarette. The device includes an enveloping element defining an interior, and an authentication device arranged in or on the enveloping element. The authentication device includes a planar loop antenna, and an authentication logic coupled to the planar loop antenna and configured to provide an authentication of the device vis-à-vis a control element of the electronic cigarette. The planar loop antenna is arranged in rolled form in the interior of the enveloping element or on the exterior of the enveloping element. The loop antenna comprises conduction sections in two opposite regions of the planar loop antenna, which extend in the longitudinal direction of the rolled loop antenna. The conduction sections of the opposite regions are arranged such that they are adjacent or overlap one another, with a result that their respective fields mutually compensate for one another at least partly.

11 Claims, 6 Drawing Sheets

(56) References Cited

FOREIGN PATENT DOCUMENTS

| | | | |
|---|---|---|---|
| EP | 3599574 | A1 | 1/2020 |
| KR | 20210123839 | A | 10/2021 |

* cited by examiner

DEVICE FOR AN ELECTRONIC CIGARETTE, ELECTRONIC CIGARETTE, METHOD FOR FORMING A DEVICE FOR AN ELECTRONIC CIGARETTE, AND METHOD FOR FORMING AN ELECTRONIC CIGARETTE

FIELD OF THE DISCLOSURE

The disclosure relates to a device for an electronic cigarette, to an electronic cigarette, to a method for forming a device for an electronic cigarette, and to a method for forming an electronic cigarette.

BACKGROUND

In some types of electronic cigarettes, a device having a cigarette-like design and a tobacco element can be received in a receiving space of a base unit.

The base element can be equipped with a heating element and configured to heat the tobacco element by means of the heating element under electronic control and thus vaporize substances (tobacco, water, etc.) contained in the tobacco element.

For a manufacturer it may be desirable to prevent a use of devices manufactured by third parties with the manufacturer's own base element, for example by requiring an authentication of the device vis-à-vis a control element of the base unit, which control element can be configured for controlling a use of the devices in the base unit.

However, the problem arises here that the devices are consumables, and so an authentication element is disposed of together with the device after use.

Accordingly, the authentication should be as cost-effective as possible.

EP 3 599 574 A1 discloses an antenna comprising two planar coils, which are arranged mechanically opposite one another and are mechanically connected in series.

SUMMARY

A device for an electronic cigarette, an electronic cigarette, a method for forming a device for an electronic cigarette, and a method for forming an electronic cigarette are provided.

In various exemplary aspects, a simply and cost-effectively producible device for an electronic cigarette (e-cigarette) is provided which enables an authentication of the device vis-à-vis a control element of the base element of the electronic cigarette.

In various exemplary aspects, the device can be provided in particular for a use in more or less cylindrical electronic cigarettes.

In various exemplary aspects, the authentication can be effected by means of near field communication (NFC).

In various exemplary aspects, an antenna with an authentication logic connected thereto can firstly be formed in planar fashion and subsequently be rolled, for example to form a cylinder, in order to be integrated into the device (which contains the tobacco as a consumable product). By means of an inductive coupling to a reader arranged in the base element, the antenna can enable the authentication of the device vis-à-vis a control element in the base element. The base element can subsequently enable the use of the device as part of the electronic cigarette, for example enable electronically controlled vaporization of the tobacco.

BRIEF DESCRIPTION OF THE DRAWINGS

Exemplary aspects of the disclosure are illustrated in the figures and are explained in greater detail below.

DETAILED DESCRIPTION

In the following detailed description, reference is made to the accompanying drawings, which form part of this description and show for illustration purposes specific aspects in which the disclosure can be implemented. In this regard, direction terminology such as, for instance, "at the top", "at the bottom", "at the front", "at the back", "front", "rear", etc. is used with respect to the orientation of the figure(s) described. Since components of aspects can be positioned in a number of different orientations, the direction terminology serves for illustration and is not restrictive in any way whatsoever. It goes without saying that other aspects can be used and structural or logical changes can be made, without departing from the scope of protection of the present disclosure. It goes without saying that the features of the various exemplary aspects described herein can be combined with one another, unless specifically indicated otherwise. Therefore, the following detailed description should not be interpreted in a restrictive sense, and the scope of protection of the present disclosure is defined by the appended claims.

In the context of this description, the terms "connected", "attached" and "coupled" are used to describe both a direct and an indirect connection, a direct or indirect attachment and a direct or indirect coupling. In the figures, identical or similar elements are provided with identical reference signs, insofar as this is expedient.

In various exemplary aspects, the authentication logic can be arranged at a sufficient distance from a region of the device that is hot during operation so as to ensure that the authentication logic does not overheat during operation of the electronic cigarette.

Figure 1A:
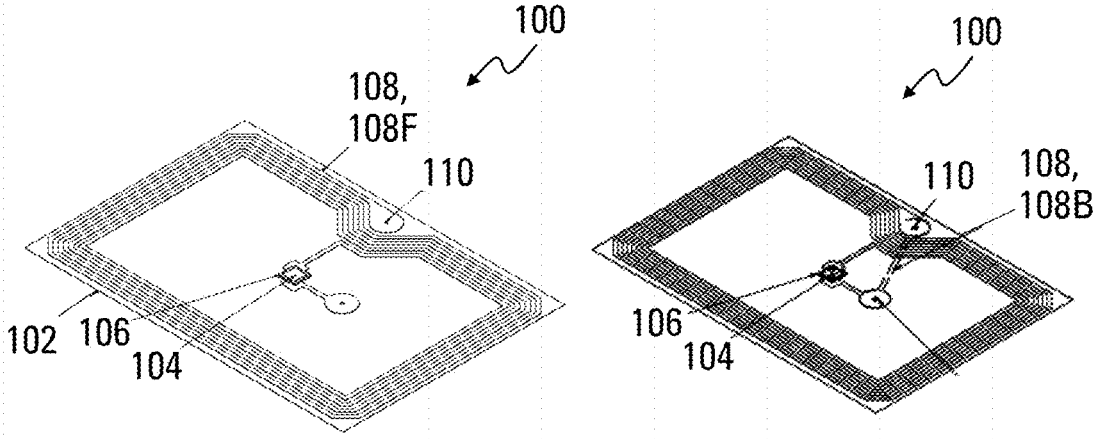
FIGS. 1A to 1C show an illustration of production of a device for an electronic cigarette in accordance with various exemplary aspects.
Figure 1B:
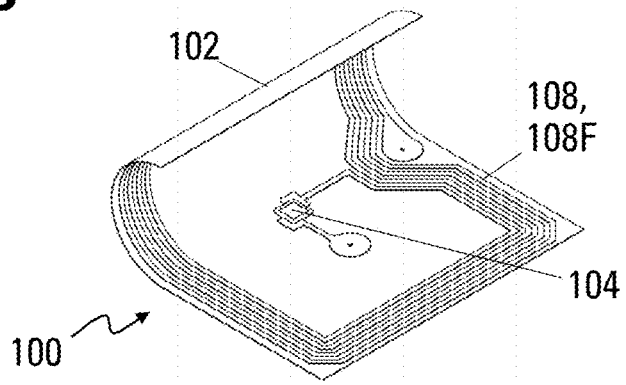
Figure 1C:
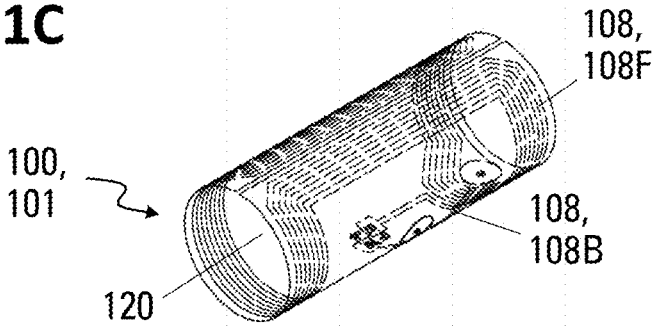
Figures 1, 1D:
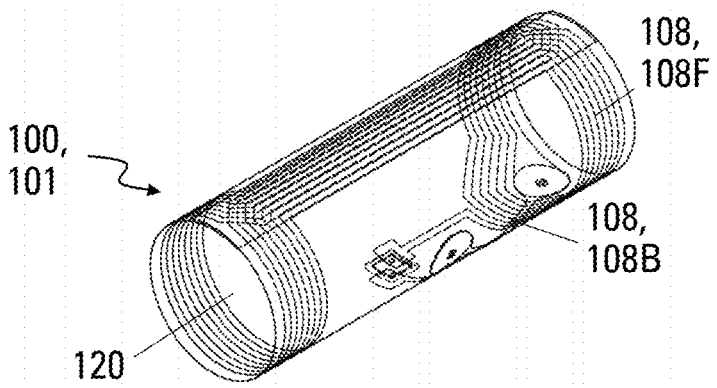
FIG. 1D (comprising FIGS. 1D-1 to 1D-3) shows a schematic illustration of a device for an electronic cigarette in accordance with various exemplary aspects.
Figures 1, 1D, 2:
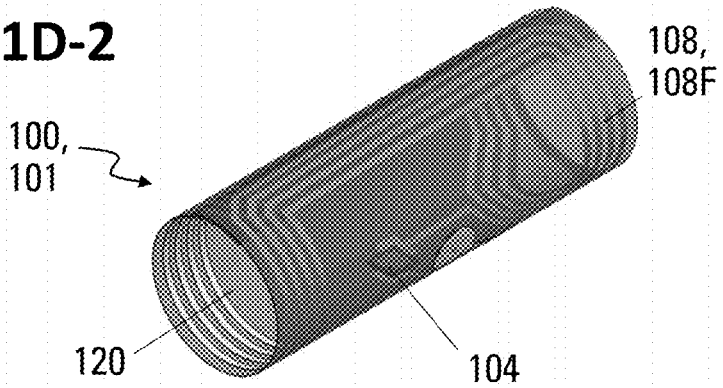
Figures 1, 1D, 2, 3:
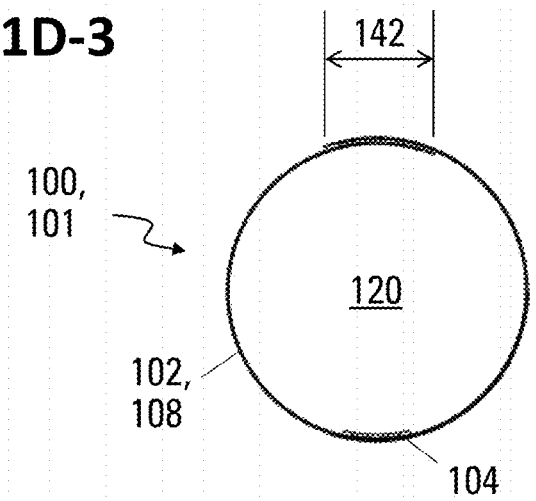
FIG. 3 shows a schematic partial illustration of an electronic cigarette in accordance with various exemplary aspects.
Figure 2A:
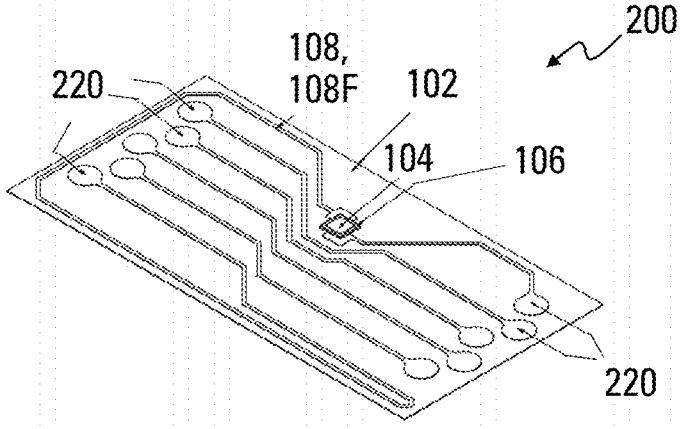
FIGS. 2A to 2C show an illustration of production of a device for an electronic cigarette in accordance with various exemplary aspects.
Figure 2B:
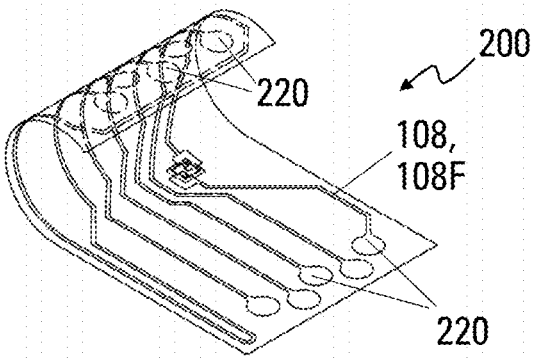
Figure 2C:
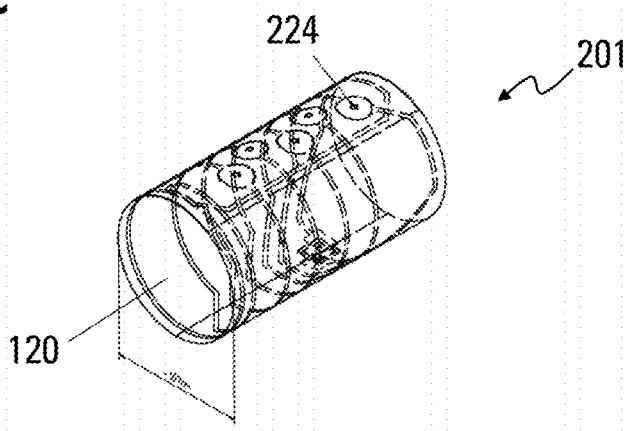
Figure 3:
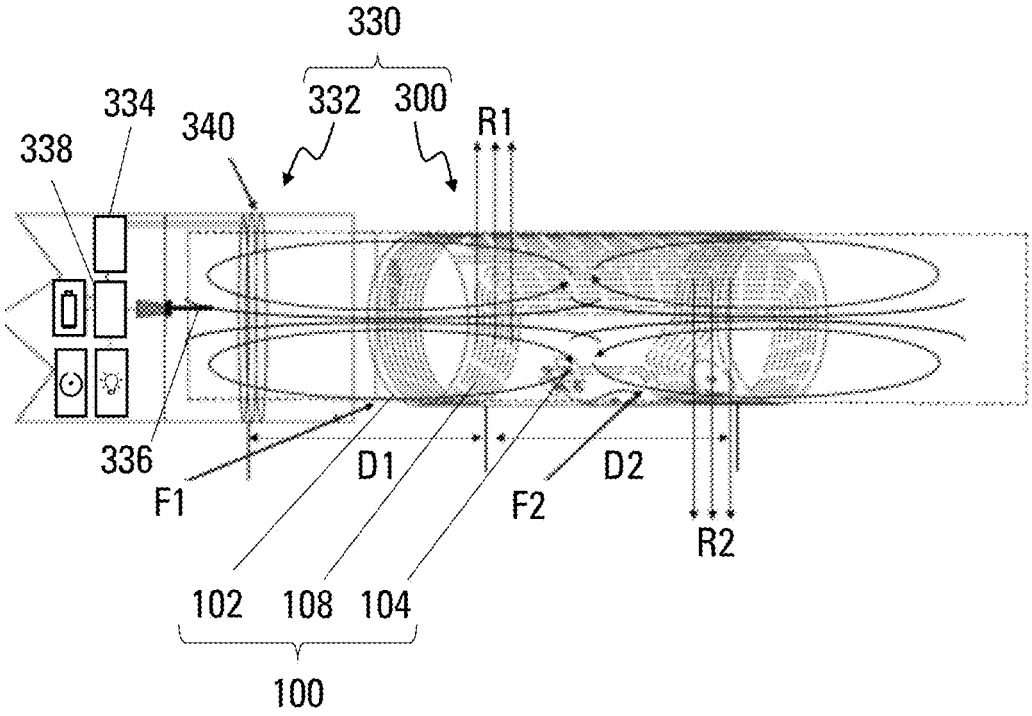
Figures 1, 4:
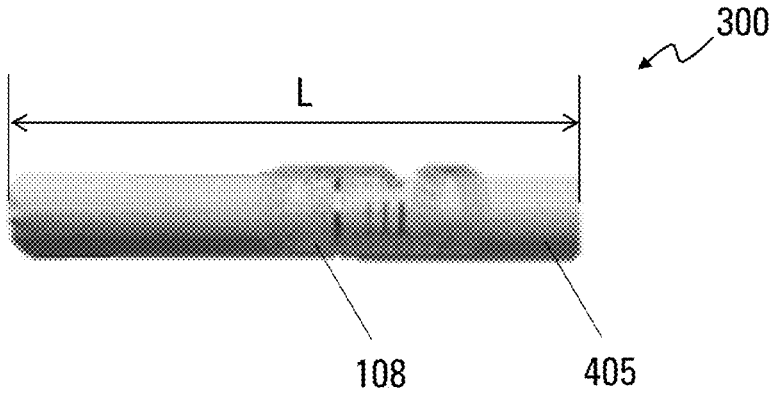
FIG. 4 (comprising FIGS. 4-1 to 4-2) shows a (partly schematic) complete view and an exploded view of a device for an electronic cigarette in accordance with various exemplary aspects.
Figures 2, 4:
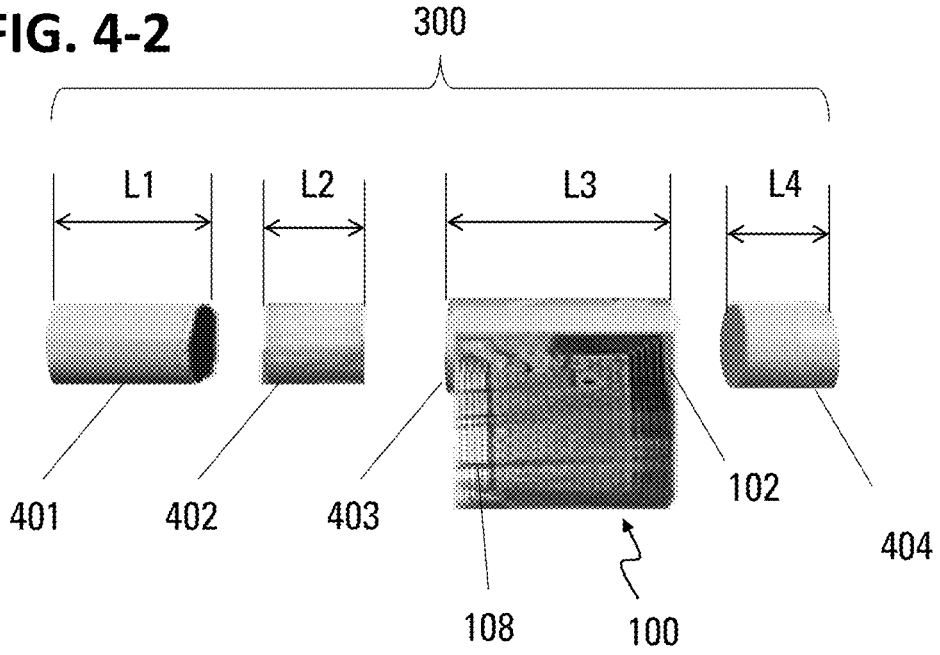

FIGS. 1A to 1C show an illustration of production of a device 100 for an electronic cigarette 330 in accordance with various exemplary aspects, FIG. 1D shows a schematic illustration of a device for an electronic cigarette in accordance with various exemplary aspects, FIGS. 2A to 2C show an illustration of production of a device 200 for an electronic cigarette 330 in accordance with various exemplary aspects, FIG. 3 shows a schematic partial illustration of an electronic cigarette 330 in accordance with various exemplary aspects, and FIG. 4 shows a (partly schematic) complete view and an exploded view of a device 300 for an electronic cigarette 330 in accordance with various exemplary aspects.

The device 100, 200, 300 can comprise an enveloping element 102 defining an interior 120, and an authentication logic 104 arranged in or on the enveloping element 102, wherein the authentication logic (authentication device) 104 comprises a planar antenna 108 and an authentication logic 104 coupled to the planar antenna 108 and configured to provide an authentication of the device 100, 300 vis-à-vis a control element 338 of the base element 332 of the electronic cigarette 330, and wherein the planar antenna 108 is arranged in rolled form (e.g. after having been rolled up, with the result that the rolled antenna 108 has for example a shape that follows a lateral surface of a cylinder) in the interior 120 of the enveloping element 102 or on the exterior of the enveloping element 102.

The enveloping element 102 can comprise or consist of a flexible substrate (which is e.g. at least capable of being rolled up).

The enveloping element 102 can comprise paper and/or plastic, for example. Particularly in a case where the enveloping element 102 comprises paper, the enveloping element 102 can comprise or be an enveloping element 102 which is provided for the device 100, 200, 300 anyway and which can obtain an additional function as substrate for the antenna 108.

In this respect, see by way of example the device 300 from FIG. 4, in which the device 100 comprises the enveloping element 102 configured to envelop a cooling element 403 of the device 300.

The cooling element 403 can serve for example to cool tobacco-enriched aerosols that are formed by means of the heating of a tobacco element 401 comprising a tobacco preparation and that are fed to the cooling element 403 through the hollow element 402. The cooling element 403 can be formed as a polymer film filter, for example.

The device 300 can furthermore comprise a filter element 404, which can be designed in a manner similar to a filter of a conventional cigarette and can thus create a typical cigarette filter feeling against the user's lips.

In various exemplary aspects, the enveloping element 102 can alternatively or additionally envelop wholly or partly the hollow element 402, the filter element 404 and possibly even the tobacco element 401 and optionally additional elements, as long as it is ensured that the authentication logic 104 is situated in a region of the device 100, 200, 300 whose temperature does not exceed a temperature tolerance range of the authentication logic 104 during operation of the electronic cigarette 330, i.e. during heating of the tobacco element 401 (which is typically heated to a temperature of approximately 350° C. in order to vaporize the tobacco or constituents of the tobacco element 401).

The authentication logic 104 can be provided as a chip or chip module, for example. Such an authentication logic 104 can typically function reliably up to a temperature of approximately 100° C.

In the region of the cooling element 403, an operating temperature can typically be approximately 80° C., and so this region can be suitable for positioning the authentication logic 104.

In the case of a use of an authentication logic 104 having higher temperature sensitivity (e.g. for cost reasons), at least the authentication logic 104 can be positioned further away from the tobacco element 401.

For positioning closer to the tobacco element 401, for example for an increased inductive coupling between the antenna 108 and a read antenna 340 connected to a read circuit 334, an authentication logic 104 having increased thermal stability can be used.

A positioning of parts of the antenna 108 in regions with temperatures above approximately 100° C. is typically non-critical. Accordingly, in various exemplary aspects, the enveloping element 102 can extend over a complete or almost complete length of the device 300 and the antenna 108 can surround the entire or almost the entire area of the enveloping element 102, as a result of which the effective antenna area is enlarged.

In this context, a typical length L1, L2, L3, L4 of the elements 401, 402, 403, 404 may also be relevant in order to obtain the largest possible antenna area by means of a suitable choice of one or more of the elements 401, 402, 403, 404 to be enveloped. The cooling element 403 having a length L3 of approximately 18 mm is typically significantly longer than the adjacent filter element 404 (L4 approximately 7.5 mm) and the hollow element 402 (L2 approximately 7.5 mm). A typical length L1 of the filter element 401 is approximately 12 mm.

The maximum possible antenna area corresponds approximately to the product of the length of the element or elements enveloped by the enveloping element 102 and the circumference, corresponding to approximately 21 mm given a diameter of approximately 7 mm.

The enveloping element 102 can be formed in cylindrical fashion (or in the shape of a lateral surface of a cylinder).

In various exemplary aspects, the antenna 108 can be applied directly to the enveloping element 102, with the result that the antenna 108 together with the enveloping element 102 can be brought to the cylindrical shape (shape of a lateral surface of a cylinder).

In various exemplary aspects, the antenna 108 can be fitted on the exterior of the rolled enveloping element 102. One such exemplary aspect is illustrated in FIG. 4.

In the complete illustration, the antenna 108 is arranged visible on the outside of the device 300 merely in order to illustrate the position. This is because even if such an aspect is possible, provision is typically made of a cylindrical housing 405 surrounding the enveloping element 102 and the authentication logic 104, in order to protect the authentication logic 104, e.g. in order to prevent detachment of the authentication logic 104 (e.g. of the chip).

In various exemplary aspects, the authentication logic 104 can be fitted on an inner side of the rolled enveloping element 102, for example, on an inner side of an enveloping element 102 surrounding the cooling element 403, the filter element 404 or the like (e.g. in a cylindrical fashion). In various exemplary aspects, the enveloping element 102 can form the housing 405, which can form an outermost enclosure of the device 100, 200, 300. In that case the authentication logic 104 can be arranged on an inner side of the cylindrical housing 405/enveloping element 102.

In various exemplary aspects, the antenna 108 can be printed (e.g. silver paste or copper paste) or etched (e.g. aluminum), which constitute cost-effective and expedient methods. Nevertheless, other known methods can be used for forming an antenna 108, for example laying.

In various exemplary aspects, the antenna 108 is applied directly to the enveloping element 102, e.g. to a PET substrate, paper (e.g. e-cigarette enclosure paper) or the like, which can result for example in a total thickness (substrate and antenna 108) of approximately 50 μm. In various exemplary aspects, the antenna 108 can be arranged on an additional substrate.

The authentication logic 104 can be fitted, e.g. pressed, for example as a thin chip (e.g. having a thickness of between 30 μm and 300 μm), which can have bumps as contact interfaces, on the substrate and the antenna turns 108 by means of flip-chip technology. In this case, the chips having a thickness of approximately between 30 μm and 50 μm can even be bendable, if appropriate, with the result that the chip can adapt to the antenna 108 during rolling thereof, i.e. can follow the bend. For a mechanical fixing of the chip and an electrical contacting between the chip contacts and the antenna 108, in various exemplary aspects, at least one adhesion medium 106 can be used. By way of example, an anisotropic conductive adhesive (ACA) can be used. Alternatively, for example, a nonconductive adhesive (NCA) can be used for the mechanical fixing and an additional conductive adhesive, a solder or the like can be used for the electrical contacting, or without a conductive adhesive the bumps can be pressed into the antenna 108 during adhesive bonding by means of the nonconductive adhesive.

The adhesion medium 106 can be provided as paste or in sheet/layer form, for example. If on two sides of the substrate (e.g. of the enveloping element 102) a metallization is arranged (e.g. for the electrically insulated bridging of the antenna turns for the contacting of the authentication logic 104 (e.g. of the chip) with both ends of the antenna 108, which then has a front-side region 108F and a rear-side region 108B), optionally through contacts 110 (e.g. as so-called "plated through holes" PTH or by means of crimp contacts, which are typically used in the case of applications of aluminum on PET) can be provided.

In various exemplary aspects, in the region of the authentication logic 104 (e.g. of the chip) reinforcing elements can be arranged, which prevent the authentication logic 104 (e.g. the chip) from being bent out of shape during the rolling of the substrate, or alternatively, as explained above, very thin chips can be used for the authentication logic 104, which allow the chip to be bent out of shape (in return it must e.g. also be ensured that no faults resulting from piezo effects are produced in the course of bending).

The enveloping element 102 with the antenna 108, for the purpose of forming the cylinder and/or for the purpose of securing, can be adhesively bonded to one or more of the elements 401, 402, 403, 404, for example by means of a hot melt adhesive or an adhesive film.

In various exemplary aspects, the enveloping element 102 can firstly be formed as a cylinder (lateral surface of a cylinder) and then be pushed onto one or more of the elements (401), 402, 403, 404, or the cylinder (lateral surface of a cylinder) shape of the enveloping element 102 (and of the antenna 108) can be produced by the enveloping element 102 being rolled around the element or elements (401), 402, 403, 404 and/or being secured thereto during rolling.

In various exemplary aspects, the antenna 108 can be formed as a loop antenna. That is illustrated by way of example in FIGS. 1A to 1C, FIG. 3 and FIG. 4.

That can firstly be advantageous to the effect that the entire antenna 108 can be fabricated in planar fashion and can be electrically conductively connected to the authentication logic 104, with the result that no electrical connections need be produced during or after the three-dimensional shaping (the rolling up).

A functionality of the loop antenna for an inductive coupling to a read antenna 340, which can be part of a base element 332, can be ensured by a coupling region of the loop antenna being situated (distance D1) at or near an end—facing the read antenna 340—of the loop antenna shaped in cylindrical fashion (or in the shape of a lateral surface of a cylinder), and by means of the field F1 which is formed by the antenna turns through which there is a flow in the direction R1 in the coupling region and effectively couples to the read antenna 340, and an opposite region at the other end of the loop antenna shaped in cylindrical fashion (or in the shape of a lateral surface of a cylinder) being so far away (distance D1+D2) from the read antenna 340 that the electromagnetic field F2 formed there by the antenna turns through which there is a flow in the direction R2 in the coupling region is of little importance for the inductive coupling between the read antenna 340 and the loop antenna.

Moreover, the loop antenna can comprise conduction sections in two opposite regions of the planar antenna 108, which extend in the longitudinal direction of the rolled loop antenna, i.e. on the lateral surface of the cylinder parallel to the cylinder axis. The conduction sections of the two opposite regions can be subjected to a flow through them in opposite directions and can thus generate mutually opposite fields which at least partly cancel one another out, which reduces an interference effect for the inductive coupling to the read antenna 340. In order to reduce the interference effect even further, the conduction sections of the opposite regions can be arranged such that they overlap one another. That is illustrated by way of example in FIG. 1D. The bottommost view in FIG. 1D shows a schematic cross-sectional illustration of the schematic perspective views of the device 100, 101 at the top and in the middle of FIG. 4. The device 100 from FIG. 1D differs from the device from FIG. 1C essentially in terms of the overlap region 142.

The cross-sectional illustration shows the overlap region 142, in which the conduction sections of the opposite regions are arranged one above another (in a direction perpendicular to a plane in which the planar antenna 108 is formed).

The effect of the mutually opposite regions on the coupling intensity is illustrated by way of example in FIG. 3.

In accordance with one example, the antenna 108 can be formed on the enveloping element 102 such that after rolling of the substrate individual antenna sections have to be connected to one another (for example at contact points 220 assigned in pairs, e.g. by means of crimping or laser welding), in order to form a continuous (e.g. helical) antenna 108. One such example is illustrated in FIGS. 2A to 2C. For this purpose, it may be sufficient to form the antenna 108 only on one side of the enveloping element 102.

In various exemplary aspects, the electronic cigarette 330 can comprise a base element 332 with the read antenna 340 described above and with a receiving space.

The receiving space can be configured to receive a region of the device 100, 200, 300 which is configured to be introduced into the receiving space for the purpose of operating the electronic cigarette 330. The region can comprise at least the tobacco element 401, for example.

In the case of a customary dimensioning of base element 332, receiving space and device 100, 200, 300, for example, the cooling element 403 can be arranged outside the receiving space. In a case in which the enveloping element 102 only envelops the cooling element 403, in various exemplary aspects, the antenna 108 can likewise be situated outside the receiving space during operation of the e-cigarette 330.

In various exemplary aspects in which the antenna 108 extends further in the direction of the tobacco element 401 and/or the receiving space is deeper and receives more of the device 100, 200, 300, the antenna 108 can be situated at least partly, for example with the coupling region, within the receiving space. In various exemplary aspects, the coupling region can be situated within an inner region defined by the read antenna 340.

In various exemplary aspects, the base element 332 can comprise a read circuit 334, which can be configured to carry out an authentication of the device 100, 200, 300 vis-à-vis the control element 338 of the base element 332 and to enable a use of the device 100, 200, 300 by means of the base element 332, said use being controlled by means of the control element 338. The read circuit 334 can be electrically conductively connected to the read antenna 340 in order to receive authentication information received by the read antenna 340, to process said information and accordingly to enable the use of the e-cigarette 330 (e.g. to heat up the tobacco element 401) or to deny said use.

In various exemplary aspects, communication between the authentication logic 104 and the read circuit 334 can be effected in accordance with a protocol for near field communication (NFC) or other suitable wireless data transfer methods.

The base element 332 can comprise additional operating elements such as, for example, a control element 338 (e.g. a circuit) for controlling the heating function of the heating element 336, a power supply (e.g. a battery), one or more LEDs for indicating readiness for operation and/or a rechargeable battery state, an on/off switch, etc.

In various exemplary aspects, a method is thus provided which makes it possible to utilize a substantially known antenna (or antenna inlay) production method with high manufacturing volume in order to provide a three-dimensional antenna 108 in a cost-effective manner.

Figure 5:
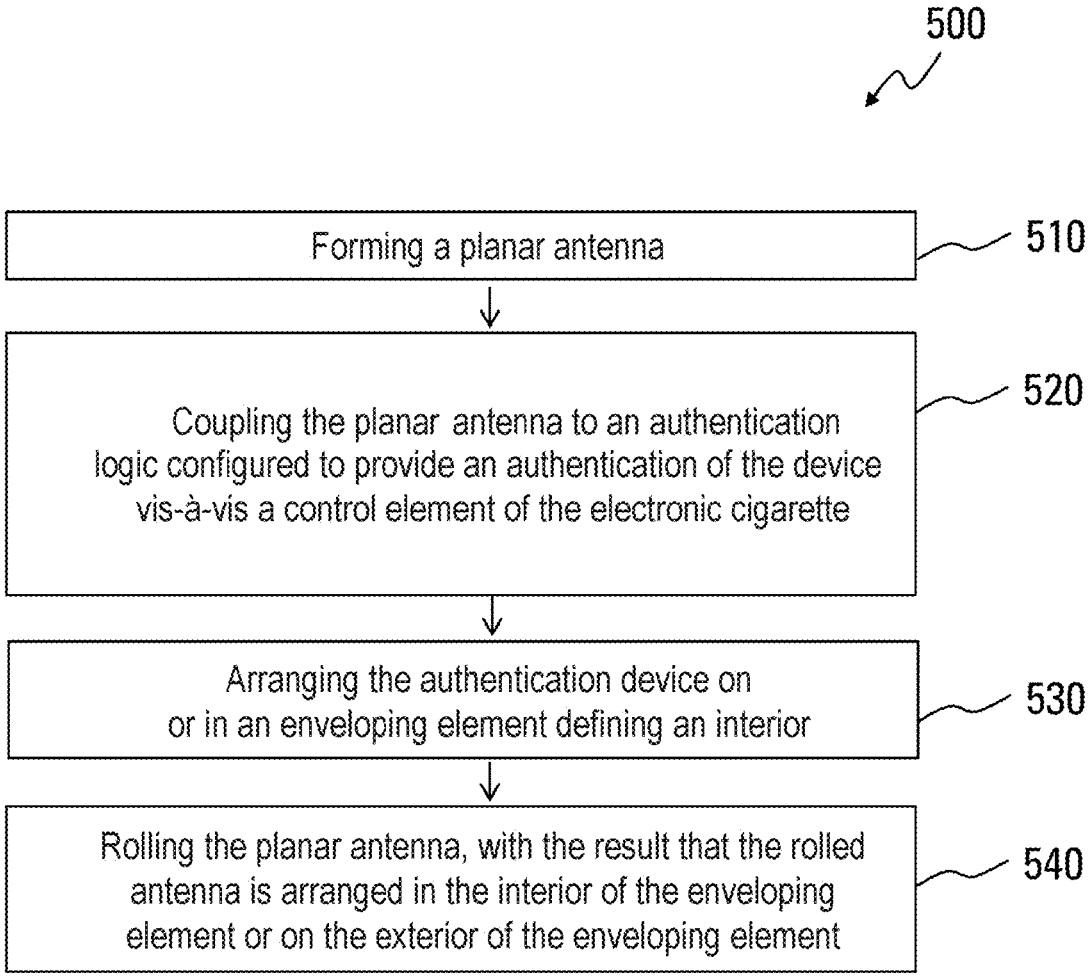
FIG. 5 shows a flow diagram of a method for forming a device for an electronic cigarette in accordance with various exemplary aspects.

FIG. 5 shows a flow diagram 500 of a method for forming a device for an electronic cigarette in accordance with various exemplary aspects.

The method comprises forming a planar antenna (step designated by 510), coupling the planar antenna to an authentication logic configured to provide an authentication of the device vis-à-vis a control element 338 of the electronic cigarette (step designated by 520), arranging the authentication device on or in an enveloping element defining an interior (step designated by 530), and rolling the planar antenna, with the result that the rolled antenna is arranged in the interior of the enveloping element or on the exterior of the enveloping element (step designated by 540).

Some exemplary aspects are specified in summary below.

Exemplary aspect 1 is a device for an electronic cigarette. The device comprises an enveloping element defining an interior, and an authentication device arranged in or on the enveloping element, wherein the authentication device comprises a planar antenna and an authentication logic coupled to the planar antenna and configured to provide an authentication of the device vis-à-vis a control element of the electronic cigarette, and wherein the planar antenna is arranged in rolled form in the interior of the enveloping element or on the exterior of the enveloping element.

Exemplary aspect 2 is a device in accordance with exemplary aspect 1, wherein the antenna is formed as a loop antenna.

Exemplary aspect 3 is a device in accordance with exemplary aspect 2, wherein the loop antenna comprises conduction sections in two opposite regions of the planar antenna, which extend in the longitudinal direction of the rolled antenna.

Exemplary aspect 4 is a device in accordance with exemplary aspect 3, wherein the conduction sections of the opposite regions are arranged such that they are adjacent or overlap one another, with the result that their respective fields mutually compensate for one another at least partly.

Exemplary aspect 5 is a device in accordance with any of exemplary aspects 1 to 4, wherein the enveloping element forms a flexible substrate.

Exemplary aspect 6 is a device in accordance with any of exemplary aspects 1 to 5, wherein the enveloping element comprises paper and/or plastic.

Exemplary aspect 7 is a device in accordance with any of exemplary aspects 1 to 6, wherein the antenna is printed.

Exemplary aspect 8 is a device in accordance with any of exemplary aspects 1 to 7, wherein the enveloping element is formed in cylindrical fashion.

Exemplary aspect 9 is a device in accordance with any of exemplary aspects 1 to 8, which furthermore comprises a cylindrical housing surrounding the enveloping element and the authentication device.

Exemplary aspect 10 is a device in accordance with any of exemplary aspects 1 to 9, wherein the authentication logic is arranged on the enveloping element.

Exemplary aspect 11 is a device in accordance with any of exemplary aspects 1 to 10, wherein the authentication logic is arranged in a region which does not exceed a temperature of approximately 100° C. during a use of the device in the electronic cigarette.

Exemplary aspect 12 is an electronic cigarette. The electronic cigarette comprises a base element having a receiving space, and a device in accordance with any of exemplary aspects 1 to 11, wherein the device furthermore comprises a region configured to be introduced into the receiving space for the purpose of operating the electronic cigarette.

Exemplary aspect 13 is an electronic cigarette in accordance with exemplary aspect 12, wherein the base element furthermore comprises a read circuit configured to carry out an authentication of the device vis-à-vis a control element of the base element and to enable a use of the device by means of the base element.

Exemplary aspect 14 is an electronic cigarette in accordance with exemplary aspect 12 or 13, which furthermore comprises at least one functional element from a group of functional elements, wherein the group comprises a hollow element, a cooling element and a filter element, and wherein the at least one functional element is arranged at least partly in the enveloping element.

Exemplary aspect 15 is a method for forming a device for an electronic cigarette, wherein the method comprises forming a planar antenna, coupling the planar antenna to an authentication logic configured to provide an authentication of the device vis-à-vis a control element of the electronic cigarette, arranging the authentication device on or in an enveloping element defining an interior, and rolling the planar antenna, with the result that the rolled antenna is arranged in the interior of the enveloping element or on the exterior of the enveloping element.

Exemplary aspect 16 is a method for forming an electronic cigarette, wherein the method comprises forming a device for an electronic cigarette in accordance with exemplary aspect 15, and receiving a region of the device that is configured for this purpose into a receiving space of a base element of the electronic cigarette.

Further advantageous configurations of the device are evident from the description of the method, and vice versa.

The invention claimed is:

1. A device for an electronic cigarette, the device comprising:

an enveloping element defining an interior; and an authentication device arranged in or on the enveloping element, wherein the authentication device comprises:

a single continuous planar loop antenna having a plurality of concentric turns formed about a common center in a single plane; and an authentication logic coupled to the single continuous planar loop antenna and configured to provide an authentication of the device with regard to a control element of the electronic cigarette;

wherein the single continuous planar loop antenna is arranged in rolled form in the interior of the enveloping element or on an exterior of the enveloping element, wherein the single continuous planar loop antenna comprises conduction sections in two opposite regions of the single continuous planar loop antenna, which extend in a longitudinal direction of the single continuous planar loop antenna arranged in rolled form, and wherein the conduction sections of the opposite regions are arranged such that they are adjacent or overlap one another, with a result that their respective fields mutually cancel one another at least partly.

2. The device as claimed in claim 1, wherein the enveloping element forms a flexible substrate.

3. The device as claimed in claim 1, wherein the enveloping element comprises paper and/or plastic.

4. The device as claimed in claim 1, wherein the loop antenna is printed.

5. The device as claimed in claim 1, wherein the enveloping element is formed in cylindrical fashion.

6. The device as claimed in claim 1, further comprising:

a cylindrical housing surrounding the enveloping element and the authentication device.

7. The device as claimed in claim 1, wherein the authentication logic is arranged on the enveloping element.

8. The device as claimed in claim 1, wherein the authentication logic is arranged in a region which does not exceed a temperature of approximately 100° C. during a use of the device in the electronic cigarette.

9. An electronic cigarette, comprising:

a base element having a space that is configured to receive a device for an electronic cigarette, the device comprising:

an enveloping element defining an interior;

an authentication device arranged in or on the enveloping element, wherein the authentication device comprises:

a single continuous planar loop antenna having a plurality of concentric turns formed about a common center in a single plane; and an authentication logic coupled to the single continuous planar loop antenna and configured to provide an authentication of the device with regard to a control element of the electronic cigarette;

wherein the single continuous planar loop antenna is arranged in rolled form in the interior of the enveloping element or on an exterior of the enveloping element, wherein the single continuous planar loop antenna comprises conduction sections in two opposite regions of the single continuous planar loop antenna, which extend in a longitudinal direction of the loop antenna arranged in rolled form, and wherein the conduction sections of the opposite regions are arranged such that they are adjacent or overlap one another, with a result that their respective fields mutually cancel one another at least partly; and the device located in the space.

10. The electronic cigarette as claimed in claim 9, wherein the base element further comprises a read circuit configured to carry out an authentication of the device with regard to a control element of the base element and to enable a use of the device by means of the base element.

11. The electronic cigarette as claimed in claim 9, further comprising:

at least one element from a group of elements consisting of a hollow element, a cooling element, and a filter element, wherein the at least one element is arranged at least partly in the enveloping element.

* * * * *